US007973801B2

(12) United States Patent
Weitbruch et al.

(10) Patent No.: US 7,973,801 B2
(45) Date of Patent: Jul. 5, 2011

(54) METHOD AND DEVICE FOR PROCESSING VIDEO DATA FOR DISPLAY ON A DISPLAY DEVICE

(75) Inventors: Sébastien Weitbruch, Mönchweller (DE); Cédric Thebault, Villingen-Schwenningen (DE); Didier Doyen, La Bouexière (FR)

(73) Assignee: Thomson Licensing, Boulogne-Billancourt (FR)

( * ) Notice: Subject to any disclaimer, the term of this patent is extended or adjusted under 35 U.S.C. 154(b) by 69 days.

(21) Appl. No.: 10/625,328

(22) Filed: Jul. 23, 2003

(65) Prior Publication Data

US 2004/0160455 A1 Aug. 19, 2004

(30) Foreign Application Priority Data

Jul. 30, 2002 (EP) ..... 02291924

(51) Int. Cl.
*G09G 5/02* (2006.01)

(52) U.S. Cl. ..... 345/596; 348/574; 358/3.13; 358/3.14; 358/3.15; 358/3.16; 358/3.17; 358/3.18; 358/3.19

(58) Field of Classification Search ..... 345/596–599; 348/574; 358/3.13–3.19
See application file for complete search history.

(56) References Cited

U.S. PATENT DOCUMENTS 4,524,447 A 6/1985 Willis et al.
4,543,599 A 9/1985 Willis et al.
4,556,900 A 12/1985 Willis
4,594,726 A 6/1986 Willis
4,647,968 A 3/1987 Willis
5,164,717 A * 11/1992 Wells et al. ..... 345/596
5,264,840 A * 11/1993 Wells et al. ..... 345/599
5,301,269 A * 4/1994 Alcorn et al. ..... 345/599
5,374,963 A 12/1994 Willis
5,436,674 A * 7/1995 Hirabayashi et al. ..... 348/699
5,712,657 A * 1/1998 Eglit et al. ..... 345/690
5,714,974 A * 2/1998 Liu ..... 345/694
5,907,316 A * 5/1999 Mikoshiba et al. ..... 345/596
5,925,875 A * 7/1999 Frey ..... 250/208.1

(Continued)

FOREIGN PATENT DOCUMENTS

EP 0656616 A1 6/1995

(Continued)

OTHER PUBLICATIONS

Definition entry for, "refine" in Merriam-Webster's Collegiate Dictionary, 10th edition. Merriam-Webster, Inc. © 2002. p. 979.*

(Continued)

*Primary Examiner* — Antonio A Caschera
(74) *Attorney, Agent, or Firm* — Robert D. Shedd; Harvey D. Fried; Sammy S. Henig

(57) ABSTRACT

A method for processing video data for display on a display device having a plurality of luminous elements comprising: applying a dithering function based on single ones of said luminous elements to at least part of said video data to refine the grey scale portrayal of video pictures of said video data, computing at least one motion vector from said video data, and changing at least one of the phase, amplitude, spatial resolution and temporal resolution of said dithering function in accordance with said at least one motion vector when applying the dithering function to said video data.

15 Claims, 4 Drawing Sheets

U.S. PATENT DOCUMENTS

| | | | | |
|---|---|---|---|---|
| 6,288,698 | B1 * | 9/2001 | Ishii et al. | 345/87 |
| 6,421,466 | B1 * | 7/2002 | Lin | 382/236 |
| 6,469,708 | B1 * | 10/2002 | Wu et al. | 345/596 |
| 6,473,464 | B1 * | 10/2002 | Weitbruch et al. | 375/240.26 |
| 6,549,576 | B1 * | 4/2003 | Moriyoshi | 375/240.16 |
| 6,647,152 | B2 | 11/2003 | Willis et al. | |
| 6,661,470 | B1 * | 12/2003 | Kawakami et al. | 348/699 |
| 6,673,429 | B1 * | 1/2004 | Ma et al. | 428/216 |
| 6,680,716 | B2 * | 1/2004 | Nakamura | 345/60 |
| 6,862,111 | B2 * | 3/2005 | Lin et al. | 358/1.9 |
| 6,909,435 | B2 | 6/2005 | Willis | |
| 6,989,845 | B1 * | 1/2006 | Okamoto et al. | 345/691 |
| 7,054,038 | B1 * | 5/2006 | Ostromoukhov et al. | 358/3.13 |
| 2002/0190940 | A1 * | 12/2002 | Itoh et al. | 345/87 |
| 2004/0218222 | A1 * | 11/2004 | Damera-Venkata | 358/3.13 |

FOREIGN PATENT DOCUMENTS

| | | | | |
|---|---|---|---|---|
| EP | 1136974 | A1 | | 3/2000 |
| EP | 1136974 | A1 | * | 9/2001 |
| JP | 60012865 | | * | 1/1985 |
| JP | 1204191 | | * | 8/1998 |
| JP | 11055518 | | * | 2/1999 |
| JP | 2000023181 | | * | 1/2000 |
| JP | 2001188901 | | * | 7/2001 |
| JP | 2003348346 | | * | 12/2003 |
| WO | WO 91/10324 | | | 7/1991 |

OTHER PUBLICATIONS

European Search Report.

D. R. Beck et al.: "Motion Dithering for Increasing Perceived Image Quality for Low-Resolution Displays" SID International Symposium. Digest of Technical Papers., Jul. 13, 1998, pp. 407-410, vol. 29, Santa Anaheim, CA, USA.

* cited by examiner

METHOD AND DEVICE FOR PROCESSING VIDEO DATA FOR DISPLAY ON A DISPLAY DEVICE

The present invention relates to a method for processing video data for display on a display device having a plurality of luminous elements by applying a dithering function to at least a part of the video data to refine the grey scale portrayal of video pictures of the video data. Furthermore, the present invention relates to a corresponding device for processing video data including dithering means.

BACKGROUND

A PDP (Plasma Display Panel) utilizes a matrix array of discharge cells, which can only be "ON", or "OFF". Unlike a CRT or LCD in which grey levels are expressed by analogue control of the light emission, a PDP controls the grey level by modulating the number of light pulses per frame (sustain pulses). This time-modulation will be integrated by the eye over a period corresponding to the eye time response. Since the video amplitude is portrayed by the number of light pulses, occurring at a given frequency, more amplitude means more light pulses and thus more "ON" time. For this reason, this kind of modulation is also known as PWM, pulse width modulation.

This PWM is responsible for one of the PDP image quality problems: the poor grey scale portrayal quality, especially in the darker regions of the picture. This is due to the fact, that displayed luminance is linear to the number of pulses, but the eye response and sensitivity to noise is not linear. In darker areas the eye is more sensitive than in brighter areas. This means that even though modern PDPs can display ca. 255 discrete video levels, quantization error will be quite noticeable in the darker areas.

As mentioned before, a PDP uses PWM (pulse width modulation) to generate the different shades of grey. Contrarily to CRTs where luminance is approximately quadratic to applied cathode voltage, luminance is linear to the number of discharge impulses. Therefore an approximately digital quadratic gamma function has to be applied to video before the PWM.

Due to this gamma function, for smaller video levels, many input levels are mapped to the same output level. In other words, for darker areas, the output number of quantization bits is smaller than the input number, in particular for values smaller than 16 (when working with 8 bit for video input) that are all mapped to 0. This also counts for four bit resolution which is actually unacceptable for video.

One known solution to improve the quality of the displayed pictures is to artificially increase the number of displayed video levels by using dithering. Dithering is a known technique for avoiding the loss of amplitude resolution bits due to truncation. However, this technique only works if the required resolution is available before the truncation step. Usually this is the case in most applications, since the video data after a gamma operation used for pre-correction of the video signal has 16-bit resolution. Dithering can bring back as many bits as those lost by truncation in principle. However, the dithering noise frequency decreases, and therefore becomes more noticeable, with the number of dithered bits.

The concept of dithering shall be explained by the following example. A quantization step of 1 shall be reduced by dithering. The dithering technique uses the temporal integration property of the human eye. The quantization step may be reduced to 0.5 by using 1-bit dithering. Accordingly, half of the time within the time response of the human eye there is displayed the value 1 and half of the time there is displayed the value 0. As a result the eye sees the value 0.5. Optionally, the quantization steps may be reduced to 0.25. Such dithering requires two bits. For obtaining the value 0.25 a quarter of the time the value 1 is shown and three quarters of the time the value 0. For obtaining the value 0.5 two quarters of the time the value 1 and two quarters of the time the value 0 is shown. Similarly, the value 0.75 may be generated. In the same manner quantization steps of 0.125 may be obtained by using 3-bit dithering. This means that 1 bit of dithering corresponds to multiply the number of available output levels by 2, 2 bits of dithering multiply by 4, and 3 bits of dithering multiply by 8 the number of output levels. A minimum of 3 bits of dithering may be required to give to the grey scale portrayal a 'CRT' look.

Proposed dithering methods in the literature (like error diffusion) were mainly developed to improve quality of still images (fax application and newspaper photo portrayal). Results obtained are therefore not optimal if the same dithering algorithms are directly applied to PDPs and mainly in the displaying of video with motion.

The dithering most adapted to PDP until now is the Cell-Based Dithering, described in the European patent application EP-A-1 136 974 and Multi-Mask dithering described in the European patent application with the filing number 01 250 199.5, which improves grey scale portrayal but adds high frequency low amplitude dithering noise, both of which are hereby incorporated by reference herein.

Cell-based dithering adds a temporal dithering pattern that is defined for every panel cell and not for every panel pixel as shown in FIG. 1. A panel pixel is composed of three cells: red, green and blue cell. This has the advantage of rendering the dithering noise finer and thus less noticeable to the human viewer.

Because the dithering pattern is defined cell-wise, it is not possible to use techniques like error-diffusion, in order to avoid colouring of the picture when one cell would diffuse in the contiguous cell of a different colour. This is not a big disadvantage, because it has been observed sometimes an undesirable low frequency moving interference, between the diffusion of the truncation error and a moving pattern belonging to the video signal. Error diffusion works best in case of static pictures. Instead of using error diffusion, a static 3-dimensional dithering pattern is proposed.

This static 3-dimensional dithering is based on a spatial (2 dimensions x and y) and temporal (third dimension t) integration of the eye. For the following explanations, the matrix dithering can be represented as a function with three variables: $\phi(x,y,t)$. The three parameters x, y and t will represent a kind of phase for the dithering. Now, depending on the number of bits to be rebuilt, the period of these three phases can evolve.

FIG. 2 illustrates the 3-dimensional matrix concept. The values displayed on the picture slightly change for each plasma cell in the vertical and horizontal directions. In addition, the value also changes for each frame. In the example of FIG. 2, for the frame displayed at time $t_o$ the following dithering values are given:

$$\phi(x_o,y_o,t_o)=A$$

$$\phi(x_o+1,y_o,t_o)=B$$

$$\phi(x_o+1,y_o+1,t_o)=A$$

$$\phi(x_o,y_o+1,t_o)=B$$

One frame later, the dithering values are at time $t_o+1$:

$$\phi(x_o,y_o,t_o+1)=B$$

$$\phi(x_o+1,y_o,t_o+1)=A$$

$$\phi(x_o+1,y_o+1,t_o+1)=B$$

$$\phi(x_o,y_o+1,t_o+1)=A$$

The spatial resolution of the eye is good enough to be able to see a fixed static pattern A, B, A, B but if a third dimension, namely the time, is added in the form of an alternating function, then the eye will be only able to see the average value of each cell.

The case of a cell located at the position $(x_o, y_o)$ shall be considered. The value of this cell will change from frame to frame as following $\phi(x_o, y_o, t_o)=A$, $\phi(x_o, y_o, t_o+1)=B$, $\phi(x_o, y_o, t_o=2)=A$ and so on.

The eye time response of several milliseconds (temporal integration) can be then represented by the following formula:

$$\mathrm{Eye}(x_o, y_o) = \frac{1}{T}\sum_{t=t_o}^{t=t_o+T} \varphi(x_o, y_o, t)$$

which, in the present example, leads to $$\mathrm{Eye}(x_o, y_o) = \frac{A+B}{2}$$

It should be noted that the proposed pattern, when integrated over time, always gives the same value for all panel cells. If this would not be the case, under some circumstances, some cells might acquire an amplitude offset to other cells, which would correspond to an undesirable fixed spurious static pattern.

While displaying moving objects on the plasma screen, the human eye will follow the objects and no more integrates the same cell of the plasma (PDP) over the time. In that case, the third dimension, will no more work perfectly and a dithering pattern can be seen.

In order to better understand this problem, the following example of a movement $\nabla=(1;0)$ shall be looked at, which represents a motion in x-direction of one pixel per frame. In that case, the eye will look at $(x_o, y_o)$ at time $t_o$ and then it will follow the movement to pixel $(x_o+1, y_o)$ at time $t_o+1$ and so on. In that case, the cell seen by the eye will be defined as following:

$$\mathrm{Eye} = \frac{1}{T}(\varphi(x_o, y_o, t_o) + \varphi(x_o+1, y_o, t_o+1) + \ldots + \varphi(x_o+T, y_o, t_o+T))$$

which corresponds to $$\mathrm{Eye} = \frac{1}{T}(A + A + \ldots + A) = A.$$

In that case, the third dimension aspect of the dithering will not work correctly and only the spatial dithering will be available. Such an effect will make the dithering more or less visible depending on the movement. The dithering pattern is no longer hidden by the spatial and temporal eye integration.

The invention relates to a way of eliminating a dithering pattern appearing for a viewer observing a moving object on a picture.

The present invention proposes a method for processing video data for display on a display device having a plurality of luminous elements by applying a dithering function to at least part of said video data to refine the grey scale portrayal of video pictures of said video data, computing at least one motion vector from said video data and changing the phase, amplitude, spatial resolution and/or temporal resolution of said dithering function in accordance with said at least one motion vector when applying the dithering function to said video data.

Furthermore, according to the present invention there is provided a device for processing video data for display on a display device having a plurality of luminous elements including dithering means for applying a dithering function to at least a part of said video data to refine the grey scale portrayal of video pictures of said video data, and motion estimation means connected to said dithering means for computing at least one motion vector from said video data, wherein the phase, amplitude, spatial resolution and/or temporal resolution of said dithering function is changeable in accordance with said at least one motion vector.

Fortunately, the dithering function or pattern has two spatial dimensions and one temporal dimension. Such a dithering function enables an enhanced reduction of quantization steps in the case of static pictures compared to error diffusion.

The dithering function may be based on a plurality of masks. Thus, different dither patterns may be provided for different entries in a number of least significant bits of the data word representing the input video level. This makes it possible to suppress the disturbing patterns occurring on the plasma display panel when using the conventional dither patterns.

Furthermore, the application of the dithering function or pattern may be based on single luminous elements called cells of the display device, i.e., to each colour component R, G, B of a pixel separate dithering numbers may be added. Such cell based dithering has the advantage of rendering the dithering noise finer and thus making it less noticeable to the human viewer.

The dithering may be performed by a 1-, 2-, 3-, and/or 4-bit function. The number of bits used depends on the processing capability. In general 3-bit dithering is enough so that most of the quantization noise is not visible.

Preferably, the motion vector is computed for each pixel individually. By doing so the quality of higher resolution dithering can be enhanced compared to a technique where the motion vector is computed for a plurality of pixels or a complete area.

Furthermore, the motion vector should be computed for both spatial dimensions x and y. Thus, any movement of an object observed by the human viewer may be regarded for the dithering process.

As already mentioned, a pre-correction by the quadratic gamma function should be performed before the dithering process. Thus, also the quantization errors produced by the gamma function correction are reduced with the help of dithering.

The temporal component of the dithering function may be introduced by controlling the dithering in the rhythm of picture frames. Thus, no additional synchronisation has to be provided.

The dithering according to the present invention may be based on a Cell-based and/or Multi-Mask dithering, which consists in adding a dithering signal that is defined for every plasma cell and not for every pixel. In addition, such a dithering may further be optimized for each video level. This makes the dithering noise finer and less noticeable to the human viewer.

The adaptation of the dithering pattern to the movement of the picture in order to suppress the dithering structure appearing for specific movement may be obtained by using a motion estimator to change the phase or other parameters of the dithering function for each cell. In that case, even if the eye is following the movement, the quality of the dithering will stay constant and a pattern of dithering in case of motion will be suppressed. Furthermore, this invention can be combined with any kind of matrix dithering.

DRAWINGS

Exemplary embodiments of the invention are illustrated in the drawings and are explained in more detail in the following description. In the drawings.

EXEMPLARY EMBODIMENTS

In order to suppress the visible pattern of a classical matrix dithering in case of moving pictures the motion of the picture is taken into account by using a motion estimator.

This will provide, for each pixel $M(x_0, y_0)$ of the screen, a vector $\overline{V}(x_0, y_0)=(V_x(x_0, y_0), V_y(x_0, y_0))$ representing its movement. In that case, this vector can be used to change the phase of the dithering according to the formula:

$$\phi(x_0-V_x(x_0,y_0),y_0-V_y(x_0,y_0),t_0)$$

More generally, the new dithering pattern will depend on five parameters and can be defined as following:

$$\zeta(x_o,y_o,V_x(x_o,y_o),V_y(x_o,y_o),t).$$

A big advantage of such a motion compensated dithering is its robustness regarding the motion vector. In fact, the role of the motion vectors is to avoid any visible pattern of the dithering during a movement that suppresses the temporal integration of the eye. Even if the motion vectors are not exact, they can suppress the pattern. According to a more optimized solution, for each pixel $M(x_0, y_0)$ of the screen, a vector $\overline{V}(x_0, y_0, t_0)=(V_x(x_0, y_0, t_0), Vy(x_0, y_0, t_0))$ representing its movement at time t0 is provided. In that case, this vector is used to change the phase of the dithering according to the formula:

$$\phi(x_0-f_x(x_0,y_0,t_0),y_0-f_y(x_0,y_0,t_0),t_0)$$

where f(x,y,t) is a recursive function described as following:

$$f_x(x_o,y_o,t_o)=(V_x(x_o,y_o,t_o)+f_x(x_o,y_o,t_o-1))\mathrm{mod}(\tau) \text{ and}$$

$$f_y(x_o,y_o,t_o)=(v_y(x_o,y_o,t_o)+f_x(x_o,y_o,t_o-1))\mathrm{mod}(\tau).$$

In this formula, $\tau$ represents the period of the dithering and $\mathrm{mod}(\tau)$ the function modulo $\tau$. For instance if $\tau=4$, there is a periodic dithering pattern on 4 frames, which means that $\phi(x_o, y_o, t_o)=\phi(x_o, y_o, t_o+4)$ and the modulo 4 functions means that: (0) mod (4)=0, (1) mod (4)=1, (2) mod (4)=2, (3) mod (4)=3, (4) mod (4)=0, (5) mod (4)=1, (6) mod (4)=2, (7) mod (4)=3 and so on.

More generally, the new dithering pattern will depend on five parameters and can be defined as following $\zeta(x_o, y_o, v_x(x_o, y_o, t), v_y(x_o, y_o, t),t)$. The only difference now is that the vectors used are taken from more than one frame. Preferably 3-bit dithering is implemented so that up to 8 frames are used for dithering. If the number of frames used for dithering is increased, the frequency of the dithering might be too low, and so flicker will appear. Mainly 3-bit dithering is rendered with a 4-frames cycle and a 2D spatial component.

Figure 1:
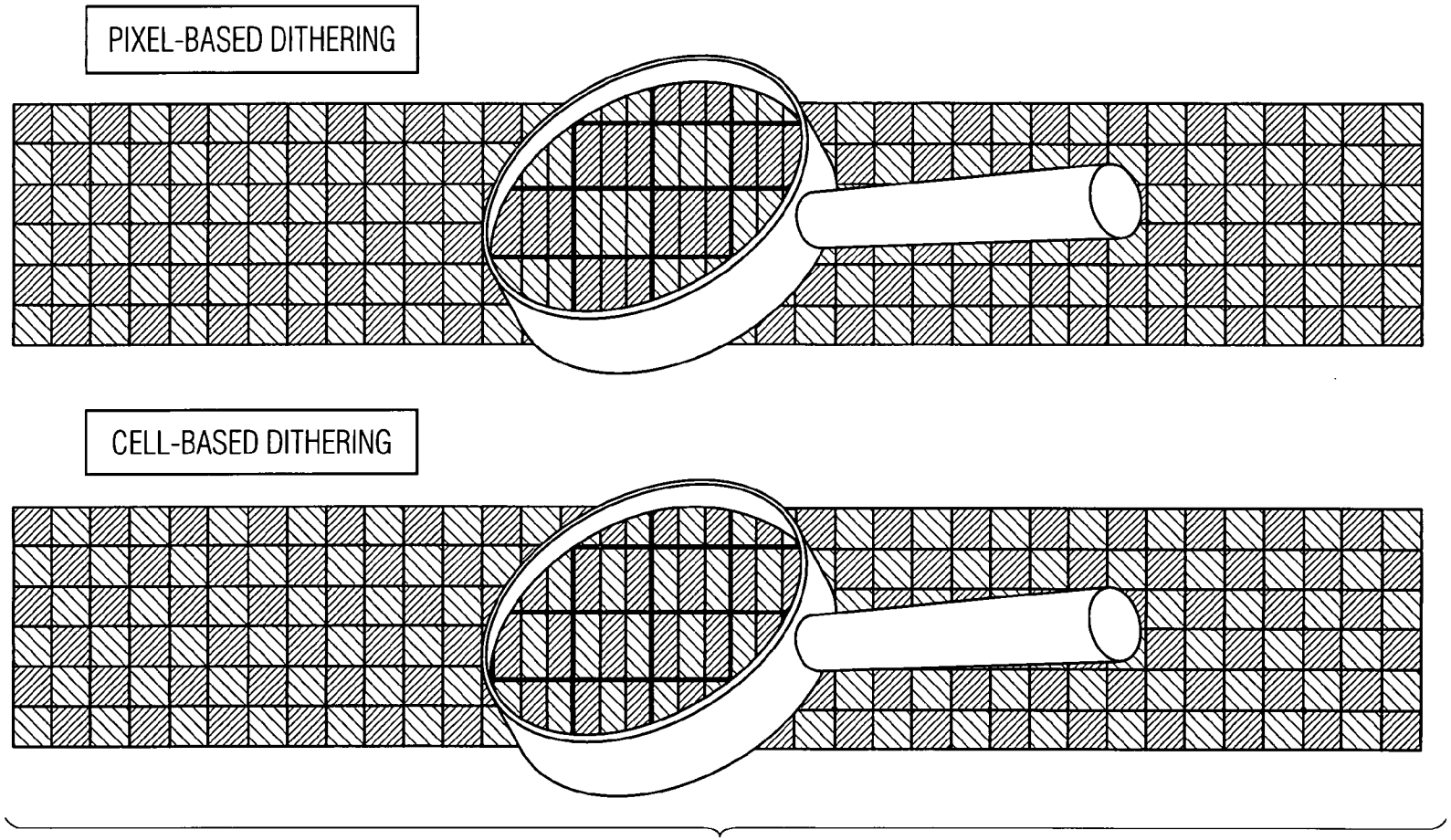
FIG. 1 shows the principal of the pixel-based dithering and cell based dithering.
Figure 2:
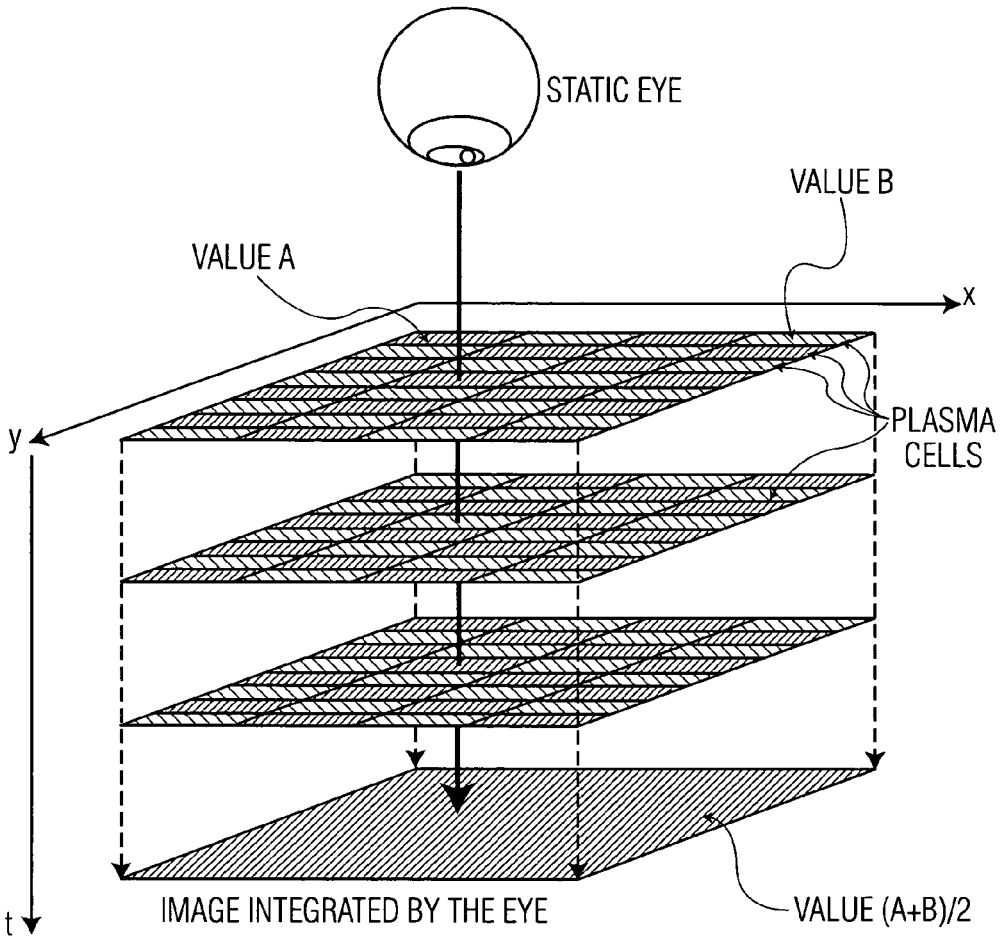
FIG. 2 illustrates the concept of 3-dimensional matrix dithering.
Figure 3:
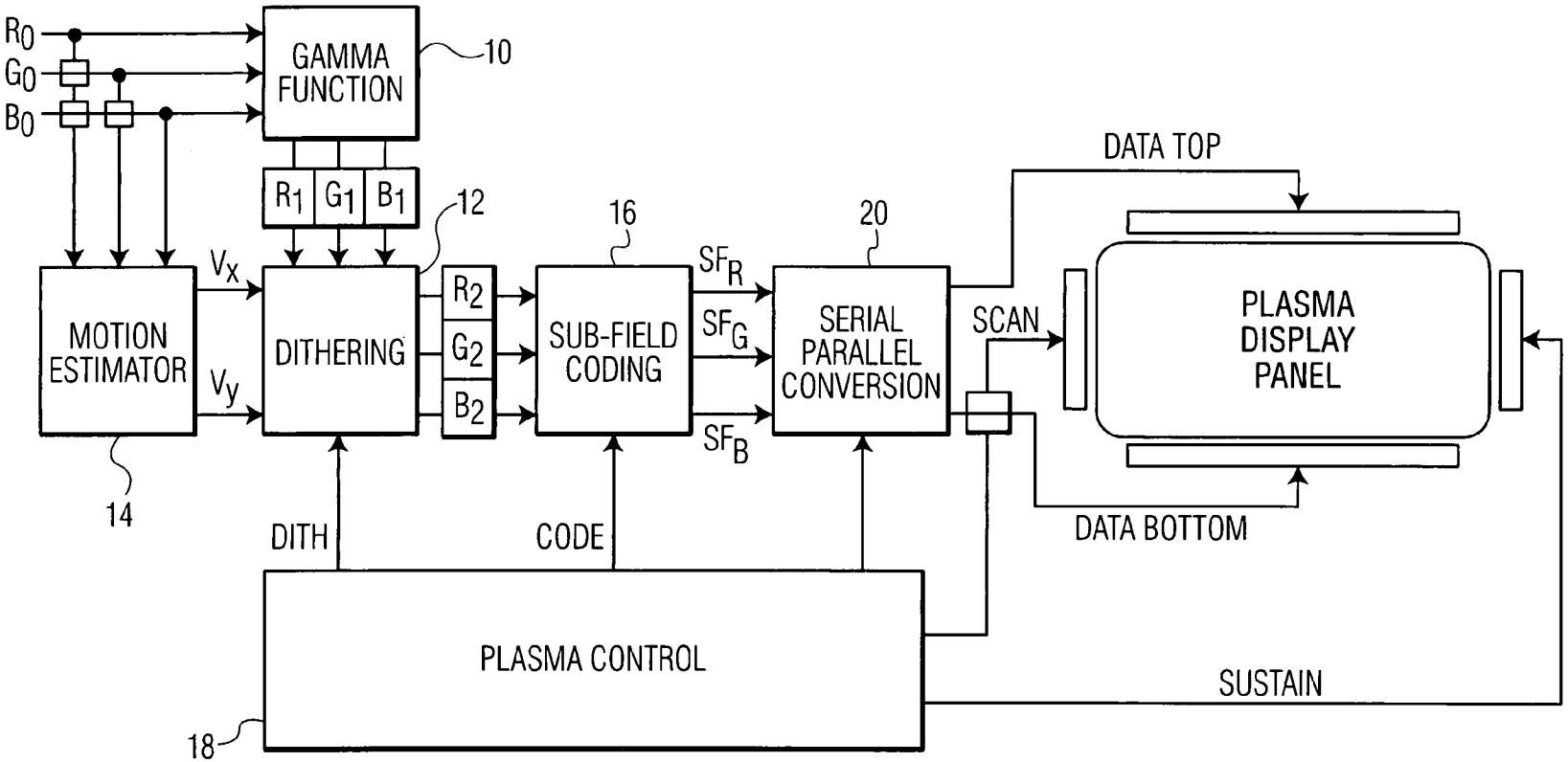
FIG. 3 shows a block diagram of a hardware implementation for the algorithm according to the present invention.

FIG. 3 illustrates a possible implementation for the algorithm. RGB input pictures indicated by the signals $R_0$, $G_0$ and $B_0$ are forwarded to a gamma function block 10. It can consist of a look up table (LUT) or it can be formed by a mathematical function. The outputs $R_1$, $G_1$ and $B_1$ of the gamma function block 10 are forwarded to a dithering block 12 which takes into account the pixel position and the frame parity as temporal component for the computation of the dithering value. The frame parity is based on the frame number within one dithering cycle. For instance, within a 3-bit dithering based on a 4-frames cycle the frame number changes cyclically from 0 to 3.

In parallel to that, the input picture $R_0$, $G_0$ and $B_0$ is also forwarded to a motion estimator 14, which will provide, for each pixel, a motion vector $(V_x, V_y)$. This motion vector will be additionally used by the dithering block 12 for computing the dithering pattern.

The video signals $R_1$, $G_1$, $B_1$ subjected to the dithering in the dithering block 12 are output as signals R2, G2, B2 and are forwarded to a sub-field coding unit 16 which performs sub-field coding under the control of the control unit 18. The plasma control unit 18 provides the code for the sub-field coding unit 16 and the dithering pattern DITH for the dithering block 12.

As to the sub-field coding, the above mentioned European patent application EP-A-1 136 974 is hereby incorporated by reference herein.

The sub-field signals for each colour output from the sub-field coding unit 16 are indicated by reference signs $SF_R$, $SF_G$, $SF_B$. For plasma display panel addressing, these sub-field code words for one line are all collected in order to create a single very long code word which can be used for the linewise PDP addressing. This is carried out in a serial to parallel conversion unit 20 which is itself controlled by the plasma control unit 18.

Furthermore, the control unit 18 generates all scan and sustain pulses for PDP control. It receives horizontal and vertical synchronizing signals for reference timing.

Figure 4:
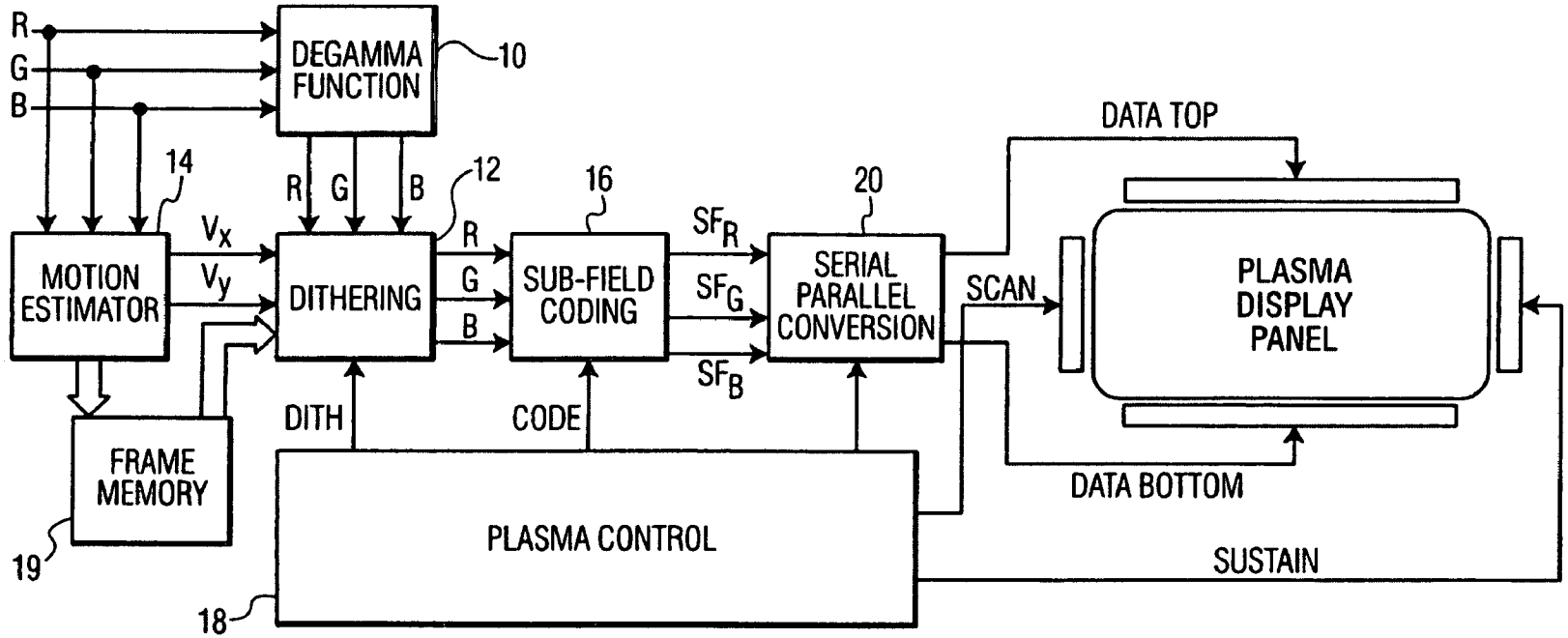
FIG. 4 shows another embodiment for the block diagram.

FIG. 4 illustrates a modification of the embodiment of FIG. 3. In this case, a frame memory 19 is used at the dithering block level. The additional memory requirements are not so strong since the value to be stored is modulo $\tau$, which is mainly around 4 for standard dithering in order to limit the temporal visibility of the dithering (low frequency). In that case, 2 bits per pixels are enough to store values that are modulo 4. For instance a WXGA panel will require 853×3×480×2=2.34 Mbit.

Although the present embodiment requires the use of a motion estimator, such a motion estimator is already mandatory for other skills like false contour compensation, sharpness improvement and phosphor lag reduction. Since the same vectors can be reused the extra costs are limited.

Motion compensated dithering is applicable to all colour cell based displays (for instance colour LCDs) where the number of resolution bits is limited.

In all cases the present invention brings the advantages of suppressing the visible pattern of classical matrix dithering in case of moving pictures and of strong robustness regarding the motion vector field.

The invention claimed is:

1. A method for processing video data in a video data processing device for display on a display device having a plurality of luminous elements to suppress a dithering pattern caused by the movement of an object on the display device from appearing to a viewer observing the moving object, the moving object represented by said video data, the method comprising:

applying a dithering function to at least part of said video data in a dithering device of the video data processing device, wherein the dithering improves a grey scale portrayal of video pictures of said video data, computing at least one motion vector from said video data in a motion estimator device of the video data processing device, said video data representing the object in motion on the display device;

changing at least one of the phase, amplitude, spatial resolution and temporal resolution of said dithering function in accordance with said at least one motion vector representing the movement of a moving object on a picture when applying the dithering function to said video data in the dithering device of the video data processing device to suppress the dithering pattern caused by the movement of the object on the display device from appearing to a viewer observing the moving object on the picture; and outputting the dithered video data from the video data processing device to the display device to suppress the dithering pattern from appearing to a viewer observing the moving object on the picture on the display device.

2. The method according to claim 1, wherein said dithering function includes two spatial dimensions and one temporal dimension.

3. The method according to claim 1, wherein said dithering function includes the application of a plurality of masks.

4. The method according to claim 1, wherein said applying of said dithering function is based on single luminous elements of said display device.

5. The method according to claim 1, wherein said dithering function is a 1-, 2-, 3- or 4-bit dithering function.

6. The method according to claim 1, wherein said at least one motion vector is defined for each of a pixel or cell individually.

7. A device for processing video data for display on a display device having a plurality of luminous elements to suppress a dithering pattern caused by the movement of an object on the display device from appearing to a viewer observing the moving object, the moving object represented by said video data, wherein said video data processing device comprises:

a dithering device for applying a changeable dithering function to at least a part of said video data to refine a grey scale portrayal of video pictures of said video data;

a motion estimator connected to said dithering device for computing and providing at least one motion vector from said video data, said video data representing the object in motion on the display device, wherein at least one of a phase, an amplitude, a spatial resolution and a temporal resolution of said dithering function is changed in accordance with said at least one motion vector in the dithering device representing the movement of a moving object on a picture, and wherein said device for processing video data comprises means for outputting said dithered video data to the display device to suppress the dithering pattern caused by the movement of the object on the display device from appearing to a viewer observing the moving object on the display device.

8. The device according to claim 7, wherein said dithering function used by said dithering means device includes two spatial dimensions and a temporal dimension.

9. The device according to claim 7, wherein said dithering function of said dithering device is based on a plurality of masks.

10. The device according to claim 7, wherein said dithering function of said dithering device is based on a single luminous element, said single luminous element called a cell of the display device.

11. The device according to claim 7, wherein said dithering device is able to process a 1-, 2-, 3- or 4-bit dithering function.

12. The device according to claim 7, wherein said at least one motion vector is definable for each pixel of the display device individually by said motion estimation device.

13. The device according to claim 7, wherein said at least one motion vector includes two spatial dimensions.

14. The device according to claim 7, further comprising gamma function means connected to said dithering device, so that the input signals of said dithering device are pre-corrected by a gamma function.

15. The device according to claim 7, further comprising controlling means connected to said dithering device for controlling said dithering device temporally in dependence of frames of said video data.

* * * * *